US008479832B2

(12) United States Patent
Tunc et al.

(10) Patent No.: US 8,479,832 B2
(45) Date of Patent: Jul. 9, 2013

(54) METHOD AND APPARATUS FOR SETTING AN INFLATABLE PACKER IN A SUBHYDROSTATIC WELLBORE

(75) Inventors: Gokturk Tunc, Cambridge (GB); Zheng Rong Xu, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 279 days.

(21) Appl. No.: 12/707,393

(22) Filed: Feb. 17, 2010

(65) Prior Publication Data

US 2010/0206571 A1 Aug. 19, 2010

Related U.S. Application Data

(60) Provisional application No. 61/153,431, filed on Feb. 18, 2009.

(51) Int. Cl.
*E21B 33/127* (2006.01)
*E21B 33/12* (2006.01)

(52) U.S. Cl.
USPC ..... 166/387; 166/188; 166/148; 166/133; 166/374

(58) Field of Classification Search
USPC ..... 166/387, 188, 133, 148, 374
See application file for complete search history.

(56) References Cited

U.S. PATENT DOCUMENTS

| | | | | |
|---|---|---|---|---|
| 3,908,769 | A * | 9/1975 | Schuyf et al. | 175/48 |
| 5,577,560 | A | 11/1996 | Coronado et al. | |
| 7,331,581 | B2 | 2/2008 | Xu et al. | |
| 7,703,512 | B2 | 4/2010 | Xu et al. | |
| 7,735,552 | B2 | 6/2010 | Xu et al. | |
| 7,735,568 | B2 | 6/2010 | Xu et al. | |
| 7,793,732 | B2 | 9/2010 | Xu et al. | |
| 2003/0178205 | A1 * | 9/2003 | Henderson | 166/387 |
| 2005/0178551 | A1 * | 8/2005 | Tolman et al. | 166/297 |

FOREIGN PATENT DOCUMENTS

GB 2370301 A 6/2002

* cited by examiner

*Primary Examiner* — Cathleen Hutchins
(74) *Attorney, Agent, or Firm* — Michael Flynn; Robin Nava; Rodney Warfford

(57) ABSTRACT

An embodiment of an assembly for setting an inflatable packer within a wellbore comprises a coiled tubing, an inflatable packer to be set in a wellbore, a back pressure valve, and a drain valve operable to allow fluid flow therepast and prevent inadvertent inflation of the inflatable packer.

21 Claims, 3 Drawing Sheets

METHOD AND APPARATUS FOR SETTING AN INFLATABLE PACKER IN A SUBHYDROSTATIC WELLBORE

CROSS REFERENCE TO RELATED APPLICATIONS

This application claims priority under 35 U.S.C. §119(e) to U.S. Provisional Application Ser. No. 61/153,431, entitled A Method and Apparatus for Setting an Inflatable Packer in a Subhydrostatic Wellbore filed on Feb. 18, 2009, the disclosure of which is incorporated herein by reference in its entirety.

FIELD

The present disclosure relates generally to a method and an apparatus for inflating an inflatable packer in a subhydrostatic wellbore.

BACKGROUND

Inflatable packers may be attached to coiled tubing and deployed into a wellbore to perform various hydrocarbon wellbore operations. For example, such operations include, but are not limited to, setting the inflatable packer (i.e. expanding a packer to seal off a section of the wellbore) and stimulating the wellbore formation above or below the packer by pumping a treatment fluid, such as an acid into the formation, and setting the inflatable packer and pumping a water shut off fluid above or below the packer to stop water flow into the wellbore from a particular zone of the formation.

In each of these scenarios, the packer is typically unset and retrieved from the wellbore at the end of the wellbore operation. In another scenario, the packer is set and then the coiled tubing is detached from it. Cement can then be poured on top of the packer creating a plug in the wellbore. The packer, in this case, is permanently left in the wellbore.

For a packer, such as an inflatable packer, to function properly, it is desirable that the differential pressure between an inside and an outside of the packer stays below a certain differential threshold. This threshold is different for different packer designs. As the expansion ratio of the packer increases (in other words as the packer is inflated in larger wellbores, or as the amount of radial expansion needed for the packer to engage a wellbore wall goes up) the differential pressure that the packer can withstand decreases. This is a limiting factor in many cases for inflatable packer operations. Often times during the design of a wellbore operation, the operator needs to consider the setting diameter of the packer and what the differential pressure is going to be at different stages of the operation.

The pressure inside the coiled tubing is usually applied to the packer during an inflation or expansion of the packer. This pressure is created by the hydrostatic pressure of the column of fluid in the coiled tubing and a pump connected to the coiled tubing at a surface of the wellbore.

The most common ways of creating inflation pressure in an inflatable packer to radially expand and "set" the packer in a wellbore are by orifice inflation and by bullhead inflation. In orifice inflation, a coiled tubing fluid is pumped through a single or a set of orifices. A portion of the fluid goes into the packer and is used to inflate the packer. This is a flow rate dependent inflation process. Flow rate is increased in a step by step fashion and at every step more fluid goes into the packer. In bullhead inflation, a coiled tubing fluid is applied directly into the packer. This is a pressure driven inflation technique rather than a flow rate dependent one. Therefore, it is a harder-to-control type of inflation process. Since the packers only need a very small volume of fluid (typically around 3-15 gallons) the inflation process is performed by discrete pumping instead of the constant pumping that is needed for orifice inflation.

Wellbores having low bottom hole pressure pose a particularly challenging problem when it comes to running inflatable packers. In these wellbores, the hydrostatic pressure of the fluid inside the coiled tubing is greater than the bottom hole pressure in the wellbore, which may cause an inflatable packer to inadvertently start inflating as the coiled tubing is lowered into the wellbore. To prevent an inflatable packer from inadvertently inflating, a common practice is to limit an amount of fluid in the coiled tubing as it is lowered into the wellbore. This is sometimes referred to as dry running, and may involve filling the coiled tubing to about 20% of its capacity. However, although this technique helps with the inadvertently inflating problem, it is not ideal.

It is desirable, therefore, to provide an improved process and/or apparatus for setting an inflatable packer in a subhydrostatic wellbore.

SUMMARY

An embodiment of an assembly for setting an inflatable packer within a wellbore comprises a coiled tubing, an inflatable packer to be set in a wellbore, a back pressure valve, and a drain valve operable to allow fluid flow therepast and prevent inadvertent inflation of the inflatable packer. In an embodiment, the back pressure valve prevents the inflatable packer from inflating while conveying the inflatable packer from a surface of the wellbore to a position where setting is desired. In an embodiment, the back pressure valve provides protection to inflatable elements of the inflatable packer from an overbalance between an inside and an outside of the coiled tubing. In an embodiment, the drain valve allows a flow of a fluid therepast up to a predetermined flow rate, without creating a pressure drop. The drain valve may comprise a piston movable between an open position allowing fluid flow therepast and a closed position preventing fluid flow therepast.

In an embodiment, the assembly further comprises surface equipment connected to the coiled tubing and disposed at a surface of the wellbore. The surface equipment may comprise at least one pump for supplying a fluid to the coiled tubing. In an embodiment, the drain valve comprises a piston sub disposed therein for selectively allowing fluid flow from the back pressure valve and the inflatable packer and into the wellbore. The piston sub may be movable from an affixed position to a downhole position. The piston sub may uncover at least one port in the drain valve in the downhole position for providing fluid communication with the wellbore.

An embodiment of a method of performing a wellbore operation comprises providing a tool assembly comprising a coiled tubing, an inflatable packer to be set in a wellbore, a back pressure valve, and a drain valve; preventing inflation of the inflatable packer by allowing fluid to flow out of the tool assembly, conveying the tool assembly into the wellbore, setting the inflatable packer, and performing at least one wellbore operation. In an embodiment, preventing comprises allowing fluid flow past the drain valve into the wellbore. Preventing may comprise allowing a predetermined amount of fluid flow past the drain valve into the wellbore. In an embodiment, setting comprises shifting a piston in the drain valve from an open position to a closed position and preventing fluid from flowing out of the tool assembly. In an embodiment, setting comprises one of orifice inflation and bullhead inflation.

In an embodiment, performing at least one wellbore operation comprises performing a fracturing operation. In an embodiment, conveying further comprises flowing fluid from the surface within the coiled tubing. In an embodiment, performing comprises shifting a piston sub within the drain valve to a downhole position and uncovering ports in the drain valve to allow fluid to flow from the drain valve into the wellbore.

An embodiment of a method of inflating an inflatable packer in a subhydrostatic wellbore comprises providing a tool assembly comprising a coiled tubing, an inflatable packer to be set in a wellbore, a back pressure valve, and a drain valve operable to allow fluid flow therepast and prevent inadvertent inflation of the inflatable packer; conveying the assembly into the subhydrostatic wellbore; preventing inflation of the inflatable packer while conveying; and setting the inflatable packer. In an embodiment, setting comprises one of orifice inflation and bullhead inflation. In an embodiment, preventing comprises allowing fluid flow from the back pressure valve, through the inflatable packer and through the drain valve into the wellbore. In an embodiment, preventing comprises allowing a predetermined amount of fluid flow past the drain valve into the wellbore. In an embodiment, setting comprises shifting a piston in the drain valve from an open position to a closed position and preventing fluid from flowing out of the tool assembly. In an embodiment, a method of inflating an inflatable packer in a subhyrdostatic wellbore (i.e., a wellbore that cannot sustain the column of liquid) is disclosed. This method presents a reliable way to inflate a packer by utilizing a back pressure valve and a drain valve.

An apparatus and a method are disclosed inflating an inflatable packer in a subhyrdrostatic wellbore. In an embodiment, an assembly comprises an inflatable packer attached to a coiled tubing and further having a back pressure valve and a drain valve for controlling a movement of fluid through the assembly.

The back pressure valve prevents the inflatable packer from inflating during a conveying of the inflatable packer from a surface of the wellbore to a position where setting is desired. The back pressure valve provides protection to inflatable elements of the inflatable packer from an overbalance between an inside and an outside of the coiled tubing. The drain valve allows a flow of a fluid therepast up to a predetermined flow rate, without creating a pressure drop.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 2:
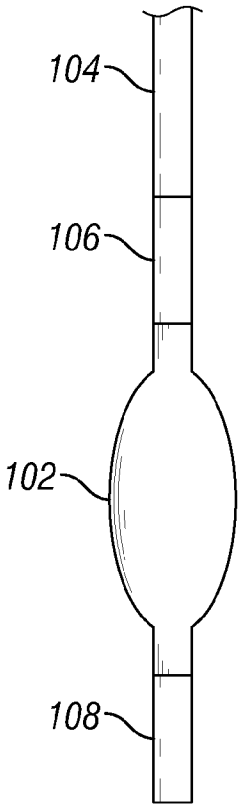
FIG. 2 is schematic partial cross sectional view of a tool assembly.
Figure 1:
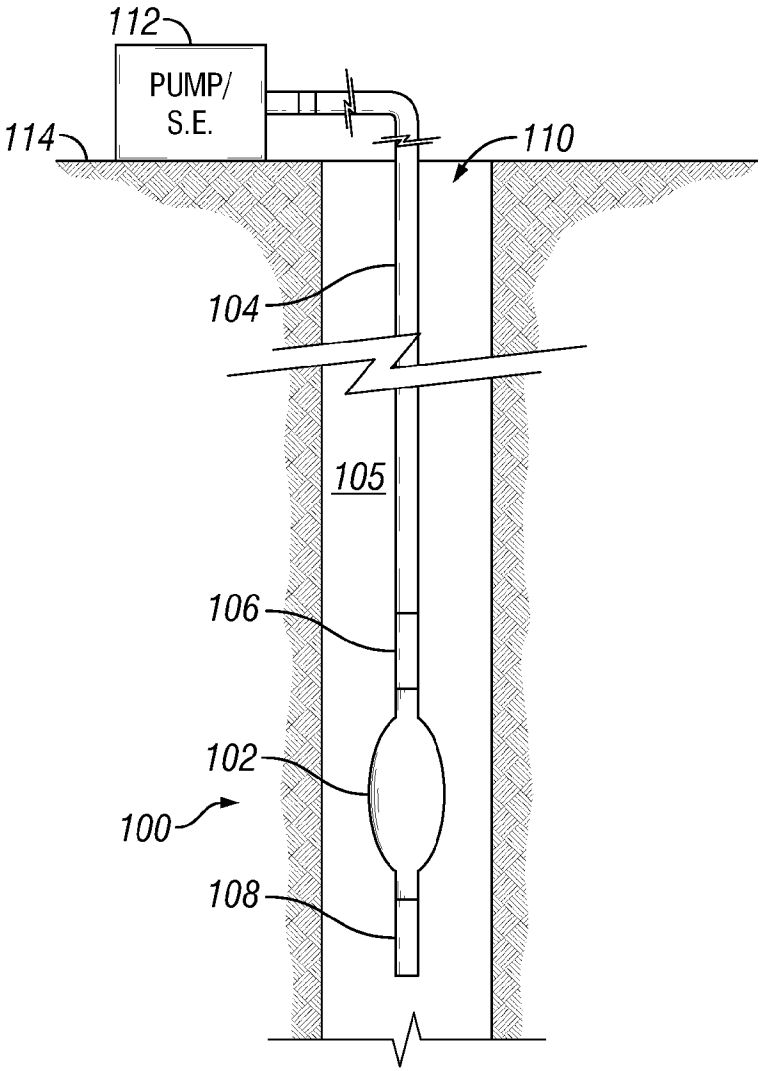
FIG. 1 is schematic partial cross sectional view of a tool assembly within a wellbore.

Referring now to FIGS. 1 and 2, an embodiment of a tool assembly comprising an inflatable packer is indicated generally at 100. The tool assembly 100 may comprise an inflatable packer 102 connected to a string of coiled tubing 104 and may also comprise a back pressure valve 106 and a drain valve 108. The tool assembly 100 is operable to be deployed in a wellbore 110 for performing various wellbore operations. The coiled tubing string 104 may be connected to suitable surface equipment 112, such as a pump(s) or the like for supplying pressurized fluid to the tool assembly 100 through the interior of the coiled tubing string 104 or through an annulus 105 defined between the wellbore 110 and the coiled tubing string 104 for performing various wellbore operations and the like, as will be appreciated by those skilled in the art.

When deployed into the wellbore 110, the coiled tubing string 106 is typically filled with a fluid, such as a wellbore servicing fluid or the like, which increases in pressure as the coiled tubing string 106 is deployed further into the wellbore 110. This pressure is created by the hydrostatic pressure of the column of fluid in the coiled tubing 104 and/or by the pump 112 connected to the coiled tubing 104 at a surface 114 of the wellbore 110. Other suitable surface equipment may comprise a coiled tubing reel, a coiled tubing injector, and similar equipment, as will be appreciated by those skilled in the art.

In an embodiment, the back pressure valve 106 provides the necessary protection to the inflatable packer 102 from the overbalance created by the differential between the inside and outside of the coiled tubing 104 (i.e., the pressure in the wellbore 110). During the conveyance of the tool or tool assembly 100 from the surface 114 to an area of the wellbore 110 where packer setting is desired, the back pressure valve 106 creates a resistance to a fluid reaching the packer 102 by preventing flow of the fluid therethrough until the back pressure valve 106 is activated, and allows fluid to flow thereby.

Figure 5:
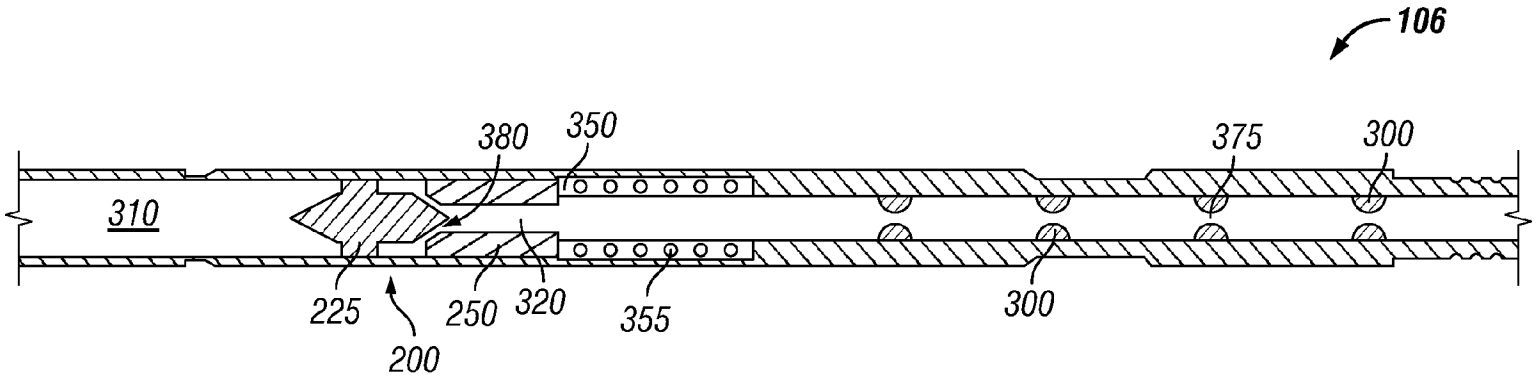
FIG. 5 is a schematic cross-sectional view of an embodiment of a backpressure valve.

Referring now to FIG. 5, an embodiment of a back pressure valve is shown generally at 106. The back pressure valve 106 may comprise a movable seat 250 biased by a spring 355 positioned against a stationary valve 225 at an interface 380 for allowing flow from an uphole chamber 310 to a downhole chamber 320 and further comprising a plurality of pressure generating flow-restrictors 300 positioned downhole of the valve assembly 200. The restrictors 300 define an orifice 375 for regulating fluid passage therethrough. The operation of the back pressure valve 106 is described in detail in U.S. patent application Ser. No. 12/135,682, filed on Jun. 9, 2008, which is incorporated herein by reference in its entirety. The back pressure valve 106 may be any appropriate or suitable back pressure valve, such as any of those shown and described in the U.S. patent application Ser. No. 12/135,682, filed on Jun. 9, 2008.

The back pressure valve 106 may also have a metal-to-metal seal, such as at the interface 380 between the stationary valve 225 and the seat 250. A small amount of fluid, therefore, may pass through the valve 104. Even though the leakage is small, since the volume between the back pressure valve 104 and the packer 102 is constant or fixed, the leakage may increase the pressure in the tool assembly 100, which may result in an undesired premature inflation of the elements of the inflatable packer 102. In an embodiment, therefore, the tool or tool assembly 100 also comprises a drain valve 108 to alleviate this problem and reduce the likelihood of inadvertent inflation of the packer 102. That is, the drain valve 108 allows flow up to a certain amount to flow therepast without creating a pressure drop. Once the operator decides to inflate the packer 102, the pump 112 pressure is increased. At a predetermined pressure, the drain valve 108 closes allowing the operator to increase the pressure in the tool assembly 100 to inflate the packer.

Figure 3:
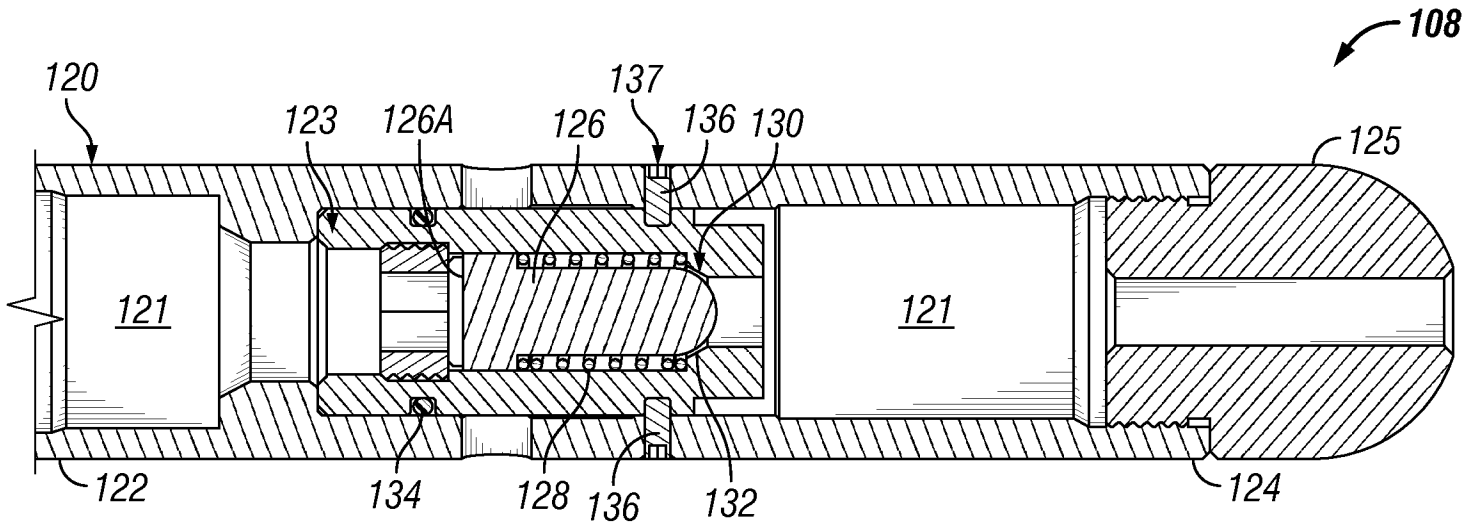
FIGS. 3 and 4 are schematic cross-sectional views, respectively, of an embodiment of a drain valve.
Figure 4:
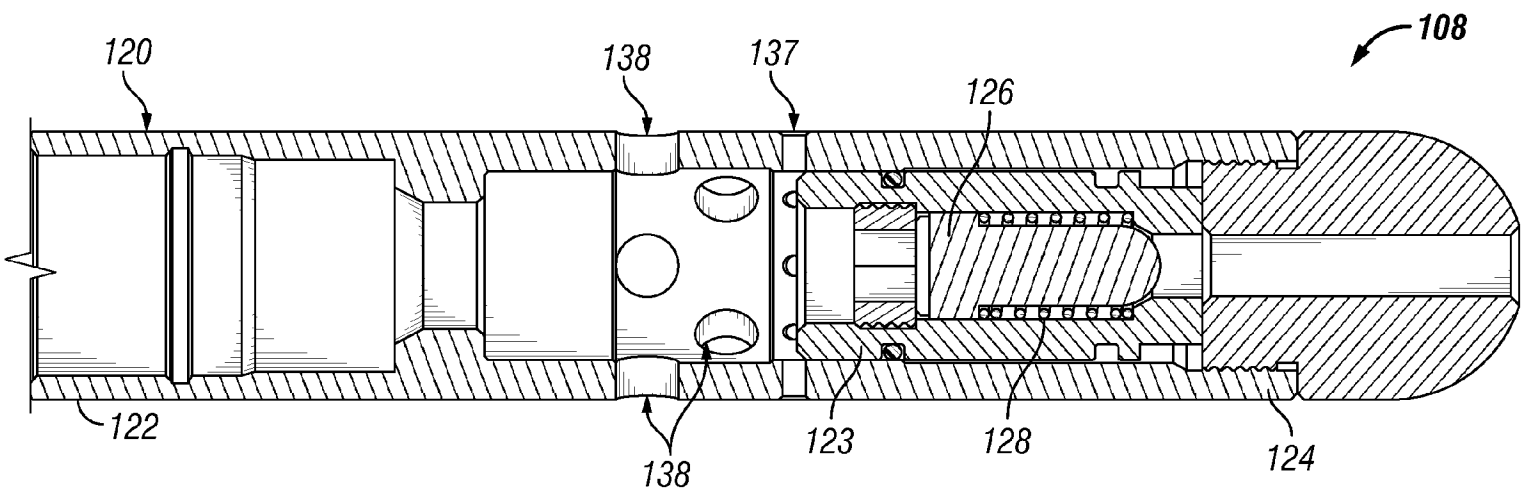

There is shown in FIGS. 3 and 4, an embodiment of a drain valve 108. The valve 108 comprises a valve body 120 defining an interior portion 121 that is open from an uphole end 122 to a downhole end 124. A piston sub 123 is disposed within the interior portion 121 and a nozzle 125 is attached to the downhole end 124, such as by a threaded connection or any suitable connection. A piston 126 is disposed in the piston sub 123 and within the flow path 122 and is biased to an open position by a spring 128. When biased to the open position, the piston 124 exposes a flow path 130 between a lower portion of the piston 126 and a seat 132. Fluid flow from the back pressure valve 104, therefore, flows from the outlet of the back pressure valve 104, through packer 102, through the uphole end 122 to the downhole end 124 via the space between the piston 126 and the piston sub 123 and the flow path 130 between the piston 126 and the seat 132 and out the flow path 121 defined by the nozzle 125. An O-ring 134 seals between an outer surface of the piston sub 123 and an interior surface of the valve body 120 and ensures that fluid flow is directed toward the flow path 130 and ultimately into the wellbore 110.

When flow and/or pressure is increased adjacent the uphole end 122 of the drain valve 108, the pressure acts on a working surface 126a of the piston. When the pressure on the working surface 126a reaches a predetermined value, the resultant force created thereby compresses the spring 128 and forces the lower portion of the piston 126 against the seat 132 to a closed position. Flow through the drain valve 108, therefore, ceases, which will allow the packer 102 to be inflated by orifice inflation or bullhead inflation, as detailed hereinabove, or any suitable inflation technique.

Flow and/or pressure may be further increased after or during inflation of the packer 102 to a predetermined value, the resultant force of which may shear a shear pin or pins 136 that affix the piston sub 123 to the valve body 120. The pins 136 are disposed in radial passages 137 formed in the valve body 120 and in a corresponding groove or indentation formed in the piston sub 123. Once the pins 136 are sheared, the piston sub 123 may move from an affixed position, shown in FIG. 4, to a downhole position, shown in FIG. 5, such that the piston sub 123 is adjacent the downhole end 124. In the downhole position, the piston sub 123 uncovers ports 138 formed in the valve body 120 such that fluid flowing from the coiled tubing 104 may flow past the packer 102 and may be routed through the ports 138 to the wellbore 110 for performing a wellbore services operation at higher flow rates. The wellbore services operation may be a fracturing operation, an acid treatment operation, water shut off operation, a well abandonment operation, a well testing procedure, a gravel packing operation, a cementing operation, a perforating operation, or similar operation, as will be appreciated by those skilled in the art. The tool assembly 100 comprising the inflatable packer 102 may also be utilized for well pressure control such as for providing pressure control to change surface equipment or tubing or for use as a downhole equipment hanger for attaching further tools or the like downstream of the inflatable packer 102. Similarly, the passages 137 are also exposed when the piston sub 123 is in the downhole position, which provides for an exit passage for any fluid from the interior 121 of the drain valve 108 that passes beyond the ports 138.

The tool or tool assembly 100 advantageously provides a tool comprising an inflatable packer and a backpressure valve that prevents inadvertent inflation of the packer by providing an exit path for leakage past the backpressure valve, such as by a drain valve or the like. The drain valve may further be configured to provide a flow path for wellbore servicing operations.

The preceding description has been presented with references to certain exemplary embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings. Instead, the scope of the application is to be defined by the appended claims, and equivalents thereof.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

What is claimed is:

1. An assembly for setting an inflatable packer within a wellbore, comprising:

a coiled tubing;

an inflatable packer to be set in a wellbore;

a back pressure valve disposed on an upstream portion of the inflatable packer towards a surface of the wellbore configured to prevent the inflatable packer from inflating while conveying the inflatable packer from the surface of the wellbore to a position where setting is desired; and a drain valve operable disposed on a downhole downstream portion of the inflatable packer to allow fluid flow therepast and prevent inadvertent inflation of the inflatable packer.

2. The assembly of claim 1, wherein the back pressure valve provides protection to inflatable elements of the inflatable packer from an overbalance between an inside and an outside of the coiled tubing.

3. The assembly of claim 1, wherein the drain valve allows a flow of a fluid therepast up to a predetermined flow rate, without creating a pressure drop.

4. The assembly of claim 3 wherein the drain valve comprises a piston movable between an open position allowing fluid flow therepast and a closed position preventing fluid flow therepast.

5. The assembly of claim 1 further comprising surface equipment connected to the coiled tubing and disposed at a surface of the wellbore.

6. The assembly of claim 5 wherein the surface equipment comprises at least one pump for supplying a fluid to the coiled tubing.

7. The assembly of claim 1 wherein the drain valve comprises a piston sub disposed therein for selectively allowing fluid flow from the back pressure valve and the inflatable packer and into the wellbore.

8. The assembly of claim 7 wherein the piston sub is movable from an affixed position to a downhole position.

9. The assembly of claim 8 wherein the piston sub uncovers at least one port in the drain valve in the downhole position for providing fluid communication with the wellbore.

10. A method of performing a wellbore operation, comprising:

providing a tool assembly comprising a coiled tubing;

an inflatable packer to be set in a wellbore;

a back pressure valve disposed on an upstream portion of the inflatable packer towards a surface of the wellbore; and a drain valve disposed on a downhole downstream portion of the inflatable packer;

preventing inflation of the inflatable packer by allowing fluid to flow out of the tool assembly by allowing fluid to flow from an interior of the coiled tubing, past the drain valve and into the wellbore;

conveying the tool assembly into the wellbore;

setting the inflatable packer; and performing at least one wellbore operation.

11. The method of claim 10 wherein preventing comprises allowing a predetermined amount of fluid flow past the drain valve into the wellbore.

12. The method of claim 10 wherein setting comprises shifting a piston in the drain valve from an open position to a closed position and preventing fluid from flowing out of the tool assembly.

13. The method of claim 10 wherein setting comprises one of orifice inflation and bullhead inflation.

14. The method of claim 10 wherein performing at least one wellbore operation comprises performing a fracturing operation.

15. The method of claim 10 wherein conveying further comprises flowing fluid from the surface within the coiled tubing.

16. The method of claim 10 wherein performing comprises shifting a piston sub within the drain valve to a downhole position and uncovering ports in the drain valve to allow fluid to flow from the drain valve into the wellbore.

17. A method of inflating an inflatable packer in a subhydrostatic wellbore, comprising:

providing a tool assembly comprising a coiled tubing;

an inflatable packer to be set in the wellbore;

a back pressure valve disposed on an upstream portion of the inflatable packer; and a drain valve disposed on a downhole downstream portion of the inflatable packer and operable to allow fluid flow therepast and prevent inadvertent inflation of the inflatable packer;

conveying the assembly into the subhydrostatic wellbore;

preventing inflation of the inflatable packer while conveying; and setting the inflatable packer.

18. The method of claim 17 wherein setting comprises one of orifice inflation and bullhead inflation.

19. The method of claim 17 preventing comprises allowing fluid flow from the back pressure valve, through the inflatable packer and through the drain valve into the wellbore.

20. The method of claim 17 wherein preventing comprises allowing a predetermined amount of fluid flow past the drain valve into the wellbore.

21. The method of claim 17 wherein setting comprises shifting a piston in the drain valve from an open position to a closed position and preventing fluid from flowing out of the tool assembly.

* * * * *